US005516164A

United States Patent [19]

Kobayashi

[11] Patent Number: 5,516,164

[45] Date of Patent: May 14, 1996

[54] DOOR LOCK DEVICE FOR A MOTOR VEHICLE

[75] Inventor: Fumio Kobayashi, Yokohama, Japan

[73] Assignee: Ohi Seisakusho Co., Ltd., Japan

[21] Appl. No.: 275,758

[22] Filed: Jul. 26, 1994

[30] Foreign Application Priority Data

Jul. 30, 1993 [JP] Japan ..... 5-189631

[51] Int. Cl.[6] ..... E05C 3/06

[52] U.S. Cl. ..... 292/201; 292/341.16; 292/DIG. 23

[58] Field of Search ..... 292/201, 216, 292/341.16, DIG. 23, DIG. 65

[56] References Cited

U.S. PATENT DOCUMENTS

| | | | |
|---|---|---|---|
| 3,332,713 | 7/1967 | Claire et al. | 292/201 |
| 3,566,703 | 3/1971 | Van Noord | 292/201 X |
| 3,989,287 | 11/1976 | Sheesley | 292/201 |
| 4,588,217 | 5/1986 | Escaravage | 292/201 |
| 5,232,253 | 8/1993 | Tamiya | 292/201 |
| 5,273,324 | 12/1993 | Kobayashi et al. | 292/216 X |
| 5,288,115 | 2/1994 | Inoue et al. | 292/216 X |

FOREIGN PATENT DOCUMENTS

| | | | |
|---|---|---|---|
| 3744135 | 7/1988 | Germany . | |
| 1122162 | 8/1989 | Japan . | |
| 2-289776 | 11/1990 | Japan | 292/DIG. 23 |

*Primary Examiner*—Rodney M. Lindsey
*Attorney, Agent, or Firm*—Bacon & Thomas

[57] ABSTRACT

A door lock device is mounted, for example, on the door of a motor vehicle such that, when a latch of the door lock device is moved to a half latch position where it barely engages a striker fastened, for example, to the vehicle body, a drive device is operated to forcibly move the latch to a full latch position where it is completely engaged with the striker. The door lock device includes a close lever coupled to the drive device and movable from a non-operation position to an operation position, and a sub-pole coupled to the close lever and movable between an engaging position where it is engaged with the latch and a releasing position where it is disengaged from the latch. The sub-pole engages the latch to move the latter to the full latch position in response to movement of the close lever to the operation position, and is moved to the releasing position upon movement of a door handle provided on the door. When the door handle is operated while the latch is being moved from the half latch position to the full latch position through the close lever and the sub-pole by the drive device, the sub-pole is disengaged from the latch to cause the latch to be disengaged from the drive device so that the door can be opened immediately.

13 Claims, 5 Drawing Sheets

DOOR LOCK DEVICE FOR A MOTOR VEHICLE

BACKGROUND OF THE INVENTION

1. Field of the Invention

This invention relates to a door lock device for a motor vehicle in which the door latch is forcibly moved from a half latch position to a full latch position by a drive device in order to reduce the door closing force.

2. Description of Related Art

A conventional door lock device of this type has been disclosed, for instance, in Japanese Unexamined Utility Model Application (OPI) No. HEI 1-122162.

The conventional door lock device operates as follows: The latch of the door lock device cooperates with a drive device so that, when the latch comes to the half latch position where the latch barely engages with the striker, the drive device operates to forcibly move the latch to the full latch position to thereby fully close the door.

The drive device has a control circuit which includes a safety circuit for operating the drive device in reverse to permit opening of the door if, for example, something becomes caught in the door while the latch of the door lock device is being moved to the full latch position by the drive device, in response to the operation of the door handle in the door opening direction.

However, the above-described conventional door lock device has the following disadvantage: In order to open the door of the drive device, the door handle must be operated in the door opening direction to cause the drive device to operate in the reverse direction and stop the movement of the latch to the full latch position. As a result, the door cannot be opened until the drive device is placed in the initial state, and it is therefore impossible to open the door immediately when required.

SUMMARY OF THE INVENTION

In view of the foregoing, an object of the invention is to provide a door lock device for a motor vehicle which, even during operation of the drive device, permits opening of the door immediately when necessary, thus contributing to improved security.

The foregoing object and other objects of the invention are achieved by the provision of a door lock device for a motor vehicle which is provided on either the body or a door of the motor vehicle, and in which when a latch pivotally provided in the door lock device is moved to a half latch position where the latch is barely engaged with a striker provided on the either the door or body of the vehicle, a drive device is operated to forcibly move the latch to a full latch position where the latch is completely engaged with the striker. The preferred door lock devices includes a close lever which is coupled to the drive device, and is movable from a non-operation position to an operation position, and a sub-pole which is coupled to the close lever and movable between an engaging position where the sub-pole is engaged with a step formed in the latch and a releasing position where the sub-pole is disengaged from the step. The sub-pole is engaged with the step to move the latch to the full latch position by the movement of the close lever to the operation position, and is moved to the releasing position in response to movement of a door handle provided on the door.

When the door handle is operated while the latch is being moved from the half latch position to the full latch position through the close lever and the sub-pole by the drive device, the sub-pole is disengaged from the latch, i.e., the latch is disengaged from the drive device, thus permitting the door to be opened immediately when required.

DETAILED DESCRIPTION OF THE PREFERRED EMBODIMENTS

Figure 1:
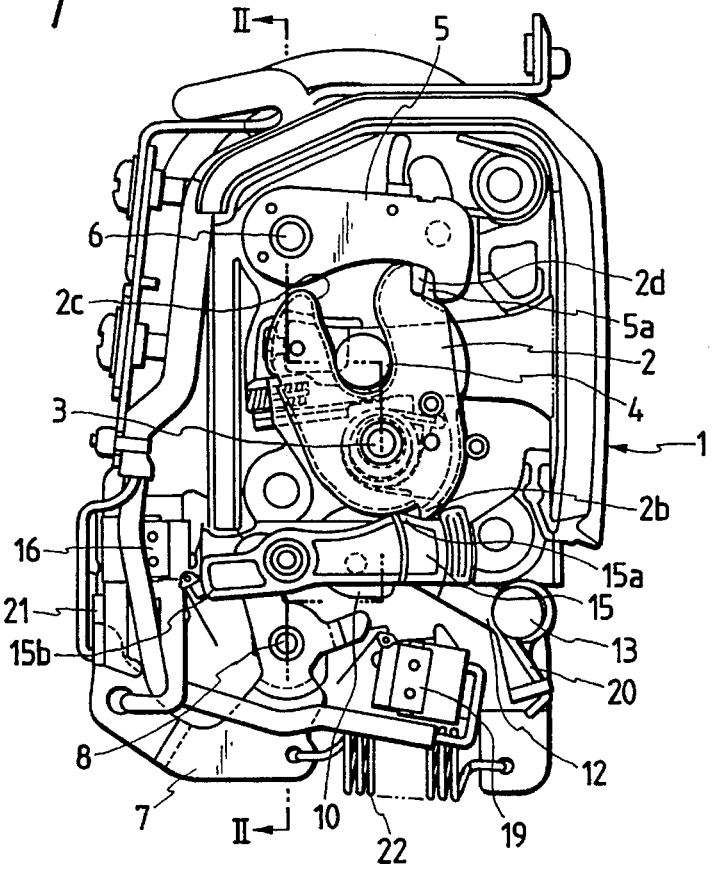
FIG. 1 is a front view of a door lock device with its cover plate removed, showing a preferred embodiment of the invention.
Figure 2:
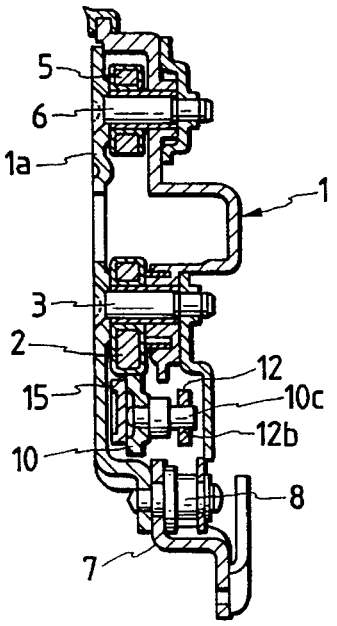
FIG. 2 is a sectional view taken along line II—II in FIG. 1.
Figure 3:
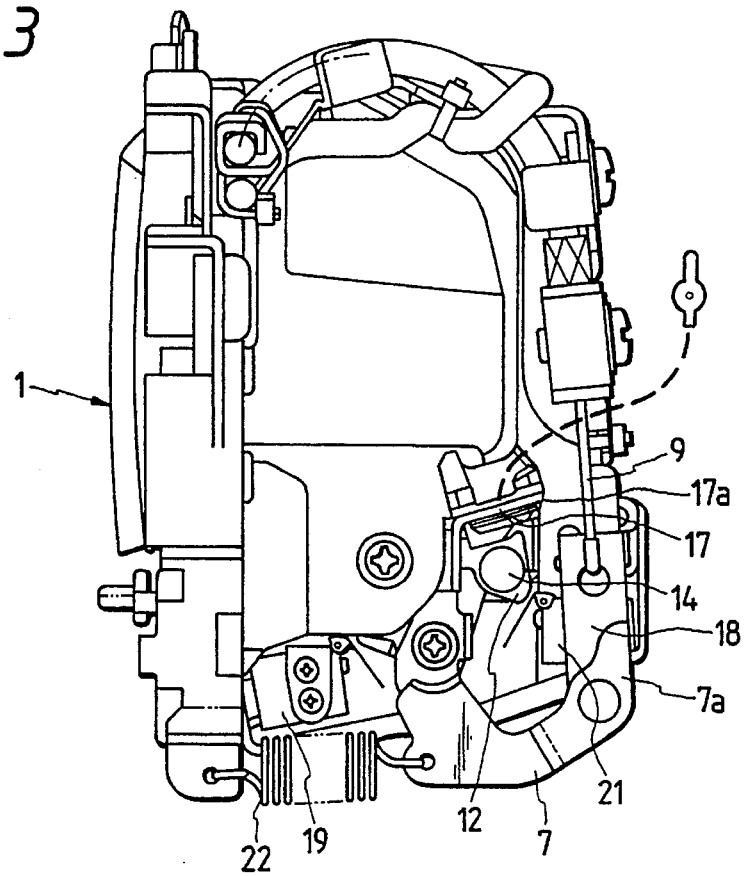
FIG. 3 is a rear view of the door lock device shown in FIG. 1.

As shown in FIGS. 1 through 3, a preferred embodiment of the invention includes a door lock body 1 attached to a door of a motor vehicle; a latch 2 which is pivotally mounted on the door lock body 1 through a shaft 3 and has in its outer circumference an engaging groove 2*a* which is engageable with a striker 4 fixedly mounted on the vehicle body, and a step 2*b* extending outwardly; and a main pole 5 in the form of a lever which is pivotally mounted on the door lock body 1 through a shaft 6 and has a pawl 5*a* which is engageable with a half latch engaging portion 2*c* or a full latch engaging portion 2*d* of the latch 2. When the pawl 5*a* is engaged with the half latch engaging portion 2*c* or the full latch engaging portion 2*d*, the latch 2 is prevented from turning towards its open position. Reference character 1*a* denotes a cover plate for the door lock body 1.

Figure 4:
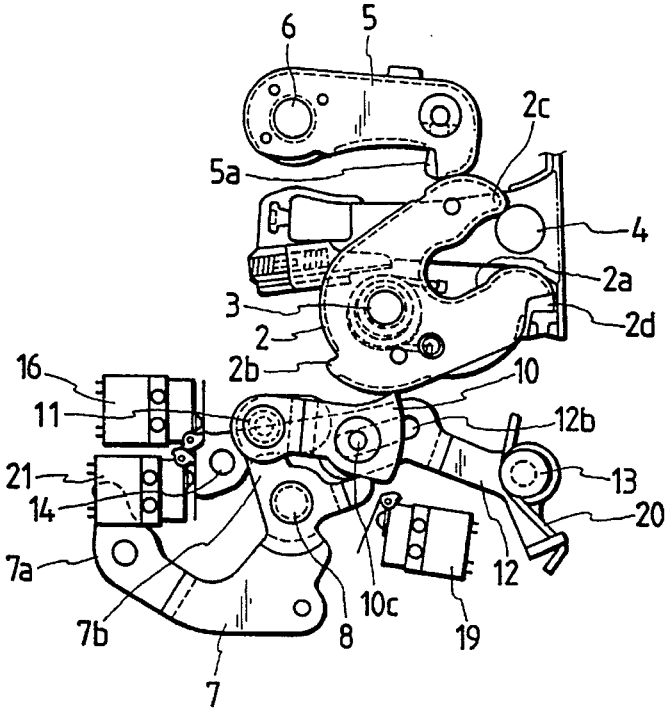
FIG. 4 is an explanatory diagram for a description of the operations of essential components with a latch at an open position in the door lock device.
Figure 6:
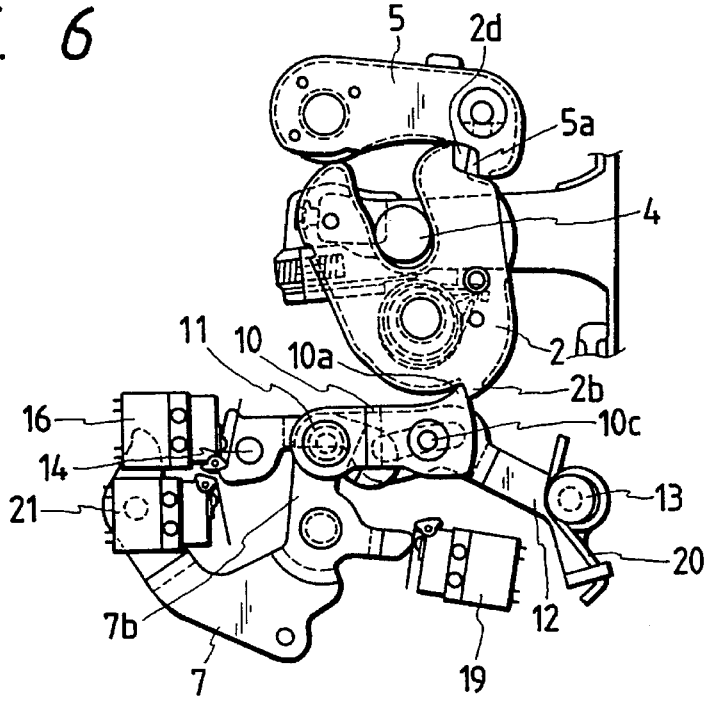
FIG. 6 is an explanatory diagram for a description of the operations of the essential components with the latch at a full latch position in the door lock device.
Figure 7:
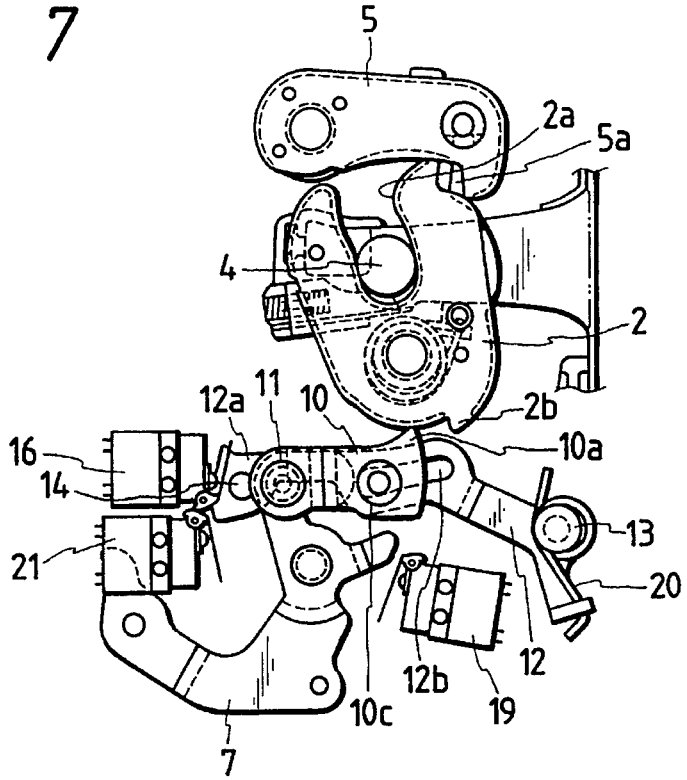
FIG. 7 is an explanatory diagram for a description of the operations of the essential components with the latch at the full latch position and with a close lever returned to a non-operation position in the door lock device.

The latch 2 has the aforementioned open position where, as shown in FIG. 4, it is disengaged from the striker 4; a half latch position where the striker 4 is barely engaged with the engaging groove 2*a* of the latch 2, and the pawl 5*a* of the pole 5 is engaged with the half latch engaging portion 2*c* of the latch 2; and a full latch position where, as shown in FIGS. 1, 6 and 7, the striker 4 is completely engaged with the engaging groove 2*a*, and the main pole 5 is engaged with the full latch engaging portion 2*d* of the latch 2.

The door lock device further includes a close lever 7 which is pivotally mounted on the door lock body 1 through a shaft 8. One end portion 7*a* of the close lever 7 is coupled to a drive device (not shown) such as an electric motor through a joint member 18 (shown in FIG. 3) and a cable 9, and the other end portion 7*b* is coupled to a sub-pole 10 which is engageable with the step 2*b* of the latch 2. More specifically, the sub-pole 10 is pivotally mounted on the other end portion 7*b* through a shaft 11. When the close lever 7 is driven by the drive device to turn clockwise from its non-operation position (shown in FIG. 5) to its operation position (shown in FIG. 6), the engaging portion 10*a* of the sub-pole 10 is engaged with the step 2*b* of the latch 2, so that the latch 2 is forcibly moved from the half latch position to the full latch position. When the latch 2 is at the open position, the engaging portion 10*a* of the sub-pole 10 abuts against the outer periphery of the latch 2; and when the latch 2 is moved to the half latch position, the engaging portion 10*a* is engageable with the step 2*b*.

As also shown in FIGS. 1 and 3, a spring 22 is interposed between the close lever 7 and the door lock body 1, to urge the close lever 7 towards the non-operation position at all times; and a full detection switch 19 is provided for detecting the operation position of the close lever 7 to output a signal to cause the drive device to operate in the reverse direction.

Figure 5:
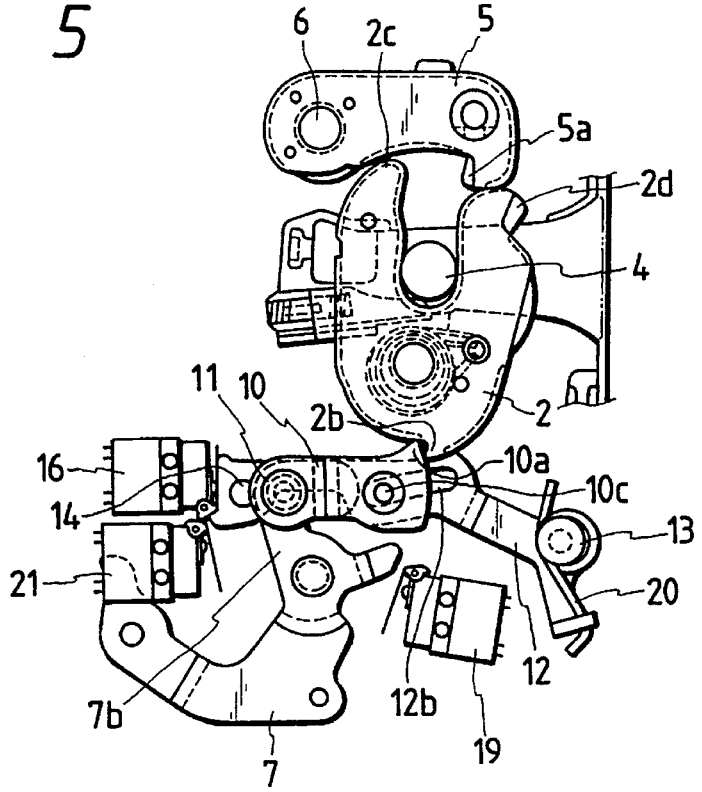
FIG. 5 is an explanatory diagram for a description of the operations of the essential components with the latch at a half latch position in the door lock device.
Figure 8:
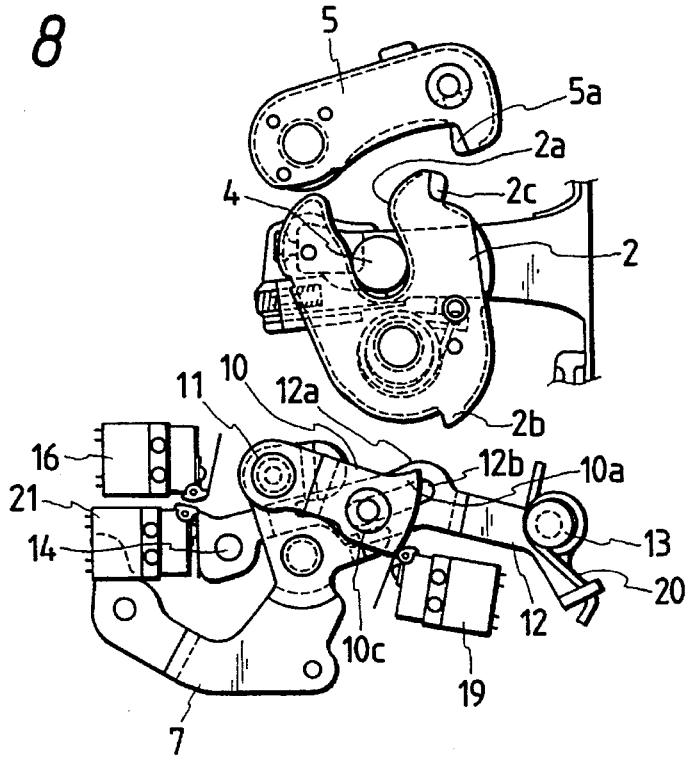
FIG. 8 is an explanatory diagram for a description of the operations of the essential components with the door opened.
Figure 9:
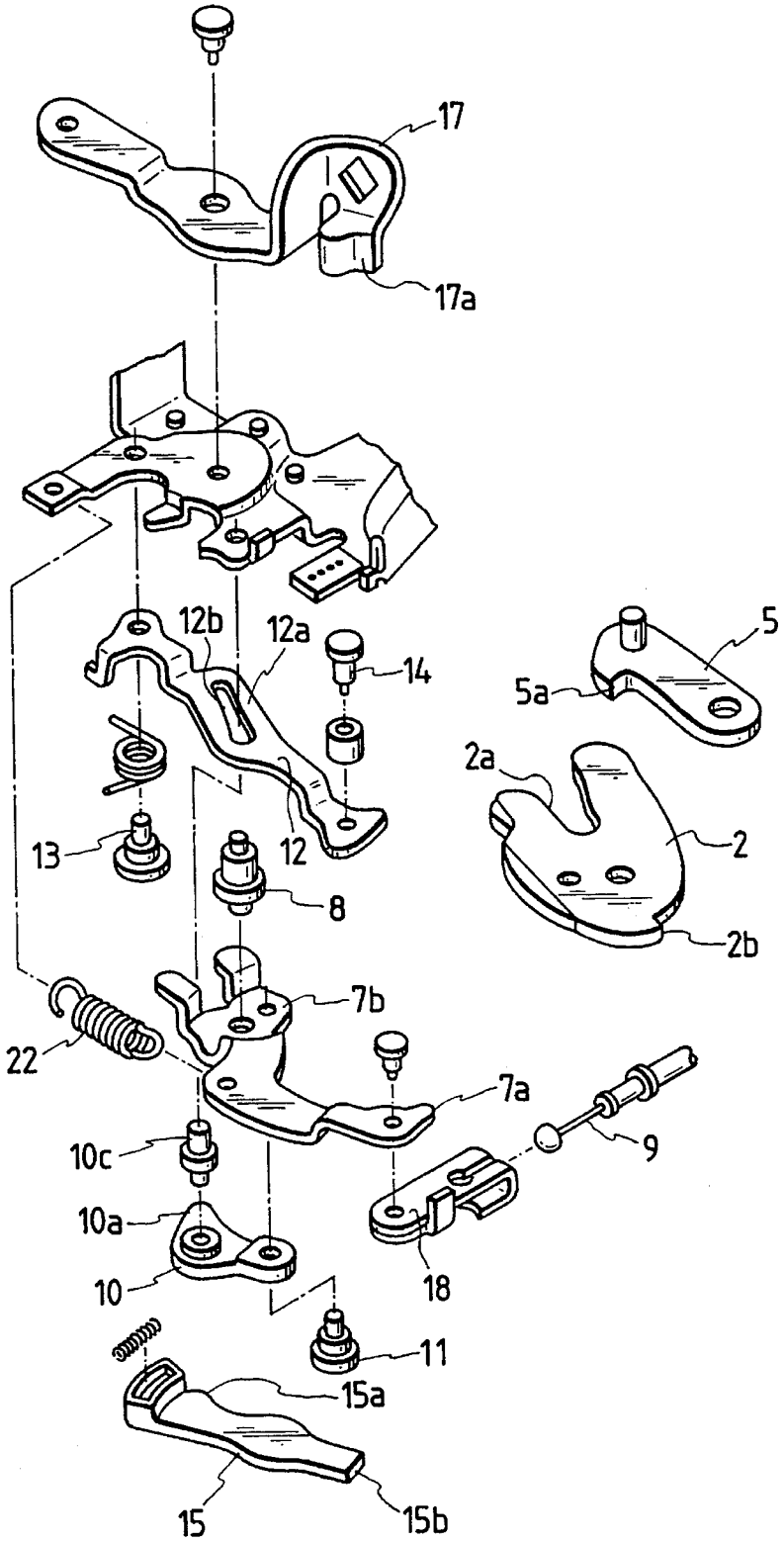
FIG. 9 is an exploded perspective view of the essential components in the door lock device.

Furthermore, as shown in FIGS. 1 and 3, an open lever 12 is pivotally mounted on the door lock body 1 through a shaft 13, and is movable between an engaging position shown in FIGS. 5 and 6 and a releasing position shown in FIG. 8. The open lever 12 includes an arm 12*a* in which an elongated hole 12*b* is formed. A shaft 10*c* embedded in the sub-pole 10 is movably engaged with the elongated hole 12*b* of the open lever 12. Reference numeral 20 designates a spring which is wound on a shaft 13, to urge the open lever 12 towards the engaging position, while reference numeral 21 denotes a half latch detection switch for detecting the engaging position of the open lever 12, to detect the half latch position of the latch 2.

The open lever 12 is coupled to the sub-pole 10 with the aid of the elongated hole 12*b* and the shaft 10*c*, so that when the engaging portion 10*a* of the sub-pole 10 is in engagement with the step 2*b* of the latch 2, the open lever 12 is at the engaging position cooperating with the sub-pole 10, and when the engaging portion 10*a* of the sub-pole 10 is in abutment with the outer peripheral of the latch 2, the open lever 12 cooperates with the sub-pole to move to the releasing position.

Reference numeral 15 designates a detecting lever pivotally mounted on the door lock body 1. The detecting lever 15 includes a protruded portion 15*a* at one end and an end portion 15*b* at the other end. When the latch 2 is at other than the full latch position, the protruded portion 15*a* of the detecting lever 15 abuts against the outer periphery of the latch 2. As the latch 2 is turned to the full latch position shown in FIG. 1, the protruded portion 15*a* is turned due to its engagement with step 2*b* of the latch 2, so that the end portion 15*b* of the detecting lever 15 turns on and off a door opening and closing detecting switch 16 fastened to the door lock device 1, to detect whether the door is opened or closed.

Reference numeral 17 designates an outside lever which is pivotally mounted on the door lock body 1. The outside lever 17 has one end portion 17*a* coupled to a door-releasing door handle which is provided on the outside of the door, to perform the door releasing operation. In the door releasing operation, the main pole 5 is moved, with the aid of a variety of levers (not shown), to the releasing position as shown in FIG. 8, while the open lever 12 and the sub-pole 10 are forcibly moved to the releasing position in abutment against the shaft 14 of the open lever 12.

In the door open state where the latch 2 is at the open position as shown in FIG. 4, the engaging portion 10*a* of the sub-pole 10 abuts against the outer periphery of the latch 2, and the sub-pole 10 and the open lever 12 are located near the releasing position. When, under this condition, the door is closed, and the latch 2 is turned slightly beyond the half latch position shown as in FIG. 5, then the engaging portion 10*a* of the sub-pole 10 is engaged with the step 2*b* of the latch, and the open lever 12 is moved together with the sub-pole 10 from the releasing position to the engaging position. This movement is detected by the half latch detecting switch 21, with the result that the drive device is operated by the control circuit.

The close lever 7 is moved from the non-operation position to the operation position through the cable 9 and the joint member 18 by the operation of the drive device. As a result, the sub-pole 10 engaged with the step 2*b* of the latch 2 forcibly turns the latch 2 to the full latch position, as shown in FIG. 6, while being guided by the elongated hole 12*b* of the open lever 12.

When the open lever 12 is moved to the operation position and the latch 2 is moved to the full latch position in the above-described manner, the full detection switch 19 detects that the full latch operation has been accomplished, and causes the control circuit to operate the drive device in the reverse direction. As a result, the close lever 7 is returned to the non-operation position as shown in FIG. 7, while the sub-pole 10 is also returned to the original position. Thus, the door opening operation has been accomplished.

When the drive device is in operation and the latch 2 is, for example, at the full latch position shown in FIG. 6 and the close lever 7 is being operated, it is assumed that opening of the door is urgent. In this case, the door handle is operated to cause the outside lever to perform the releasing operation. That is, as shown in FIG. 8, the main pole 5 is disengaged from the full latch engaging portion 2*c* of the latch with the aid of a variety of levers, and the outside lever 17 abuts against the shaft 14 of the open lever 12, so that the open lever 12 is forcibly moved from the engaging position to the releasing position and the engaging portion 10*a* of the sub-pole 10 is disengaged from the step 2 of the latch 2, i.e., the drive device is disengaged from the latch 2, and therefore the door can be opened immediately.

As is apparent from the above description, the door lock device has the following effects or merits: Even during the operation of the drive device, by operating the door handle the sub-pole is disengaged from the latch, i.e., the drive device is disengaged from the latch. As a result, the latch is allowed to move to the open position, so that the door can be opened immediately, which contributes to improved security.

While the invention has been described in detail in connection with the preferred embodiment of this invention, it will be obvious to those skilled in the art that various changes and modifications may be made therein without departing from the invention, and it is the intention of the Inventors, therefore, to cover in the appended claims all such changes and modifications as fall within the true spirit and scope of the invention.

What is claimed is:

1. For use with a motor vehicle, a door lock device including a latch pivotally mounted on one of a door and body of the vehicle, a striker engageable with the latch and mounted on the other of the door and body, and a drive device arranged to be operated to move the latch, wherein when the latch is moved to a half latch position where said latch is barely engaged with the striker, the drive device is operated to forcibly move the latch to a full latch position where said latch is completely engaged with the striker, said device further comprising:

a close lever coupled to said drive device and movable from a non-operation position to an operation position; and a sub-pole coupled to said close lever, and movable by said close lever between an engaging position where said sub-pole is engaged with a step formed in an outer circumference of said latch, and a releasing position where said sub-pole is disengaged from said step permitting disengagement of the striker and latch, said sub-pole being arranged to engage said step to move said latch to said full latch position when driven by the drive device in response to movement of said close lever to said operation position, and to be moved to said releasing position by a door handle provided on said door.

2. A device as claimed in claim 1, wherein one end of the close lever is coupled to the drive device via a cable and joint member, and the sub-pole is pivotally mounted on the other end of the close lever to selectively engage said step depending on whether the close lever is in its non-operation or operation position.

3. A device as claimed in claim 1, further comprising a switch arranged to detect movement of the close lever to the operation position to cause the drive device to operate in a reverse direction to move the close lever to the non-operation position and the sub-pole to its released position.

4. A device as claimed in claim 1, wherein the close lever is biased by a spring towards the non-operation position and moved to the operation position by the drive device responsive to the latch being moved to the half latch position.

5. A device as claimed in claim 3, further comprising a detecting lever arranged to detect turning of the latch to the full latch position and means responsive thereto for detecting opening of the door and for resetting the lock device in response thereto.

6. A device as claimed in claim 1, further comprising an open lever pivotally mounted on the door or body and movable between an engaging position and a releasing position, the open lever being coupled to the sub-pole so that when an engaging portion of the sub-pole is in engagement with the step of the latch, the open lever is at the engaging position, cooperating with the sub-pole, and when the engaging portion of the sub-pole is in abutment with an outer periphery of the latch, the open lever cooperates with the sub-pole to move it to the releasing position in response to a movement of a door release lever.

7. A device as claimed in claim 6, further comprising an outside lever connected between the door handle and the open lever to cause the open lever to be forcibly moved from the engaging position to the releasing position and disengage the sub-pole from the step.

8. A device as claimed in claim 7, further comprising a main pole which includes a pawl engageable with a half latch engaging portion or full latch engaging portion of the latch to prevent the latch from returning to its open position, the outside lever causing the main pole to release the latch when the door handle is pulled.

9. A device as claimed in claim 1, further comprising a half latch detecting switch which detect positioning of the latch in a half latch position to cause the drive device to be operated and move the sub-pole to the engaging position as the sub-pole is engaged with the step.

10. A door lock device, comprising:

a latch having a step formed in an outer circumference of the latch, said latch being movable from a half latch position to a full latch position by means of a drive device operatively connected to the latch via a sub-pole engageable with the step in the outer circumference of the latch;

means for resetting the drive device by operating it in reverse when the latch reaches the full latch position; and means for causing the sub-pole to be disengaged from the step by operating a door handle, thereby disengaging the drive from the latch and allowing the latch to be moved to an open position without resetting the drive.

11. A device as claimed in claim 10, further comprising an open lever pivotally mounted on a door lock body and movable between an engaging position and a releasing position, the open lever being coupled to the sub-pole so that when an engaging portion of the sub-pole is in engagement with the step of the latch, the open lever is at the engaging position, cooperating with the sub-pole, and when the engaging portion of the sub-pole is in abutment with an outer periphery of the latch, the open lever cooperates with the sub-pole to move it to the releasing position in response to a movement of a door release lever.

12. A device as claimed in claim 11, further comprising an outside lever connected between the door handle and the open lever to cause the open lever to be forcibly moved from the engaging position to the releasing position and disengage the sub-pole from the step.

13. A device as claimed in claim 12, further comprising a main pole which includes a pawl engageable with a half latch engaging portion or full latch engaging portion of the latch to prevent the latch from returning to its open position, the outside lever causing the main pole to release the latch when the door handle is pulled.

* * * * *